United States Patent [19]

Nagel

[11] Patent Number: 4,492,941

[45] Date of Patent: Jan. 8, 1985

[54] CIRCUIT BREAKER COMPRISING PARALLEL CONNECTED SECTIONS

[75] Inventor: Harry H. Nagel, Westwood, N.J.

[73] Assignee: Heinemann Electric Company, Lawrenceville, N.J.

[21] Appl. No.: 467,588

[22] Filed: Feb. 18, 1983

[51] Int. Cl.[3] ..... H01H 75/00

[52] U.S. Cl. ..... 335/13; 335/23; 361/102

[58] Field of Search ..... 335/6, 8, 9, 10, 13, 335/11, 23; 361/102, 115

[56] References Cited

U.S. PATENT DOCUMENTS

| | | | |
|---|---|---|---|
| 2,705,295 | 3/1955 | Edwards | 361/115 |
| 2,736,884 | 2/1956 | Yeomans | 340/253 |
| 2,817,730 | 12/1957 | Wilckens | 335/8 |
| 2,956,133 | 10/1960 | Middendorf | 200/88 |
| 2,996,589 | 8/1961 | Myers | 200/116 |
| 3,061,702 | 10/1962 | Jencks | 200/146 |
| 3,076,882 | 2/1963 | Judd et al. | 200/146 |
| 3,211,866 | 10/1965 | Crouch et al. | 200/144 |
| 3,218,428 | 11/1965 | Gauthier | 200/170 |
| 3,454,872 | 7/1969 | Kummerow | 324/28 |
| 3,469,048 | 9/1969 | Lee et al. | 200/144 |
| 3,706,056 | 12/1972 | Chabot | 335/10 |
| 4,053,876 | 10/1977 | Taylor | 340/253 H |
| 4,077,024 | 2/1978 | Lisnay | 335/8 |
| 4,079,345 | 3/1978 | Pietsch | 335/10 |
| 4,188,572 | 2/1980 | Garshelis | 323/9 |

*Primary Examiner*—Goldberg E. A.
*Assistant Examiner*—George Andrews
*Attorney, Agent, or Firm*—Peter J. Patane; Joseph G. Denny, III

[57] ABSTRACT

A circuit breaker comprising two or more sections connected in parallel with each other. Each section of the circuit breaker comprises an electromagnetic sensing device and a pair of relatively movable contacts. The electromagnetic sensing devices are electrically connected at one of their ends to the load terminals. The load terminals are electrically connected in parallel with each other. The electromagnetic sensing devices are electrically connected at their other ends to each other and are electrically connected to all of the movable contacts which are themselves all electrically connected together. The stationary contacts are connected to line terminals which are also electrically connected in parallel with each other. Thus, the electromagnetic sensing devices are connected in parallel at both of their ends and the relatively movable contacts are also connected in parallel at both of their electrical ends while the electromagnetic sensing devices, on the one hand, and the movable contacts, on the other hand, are also in series with each other, whereby the current is divided equally among all of the electromagnetic sensing devices even though the current may not be equally divided among all of the relatively movable contacts, because of varying contact resistances.

11 Claims, 6 Drawing Figures

CIRCUIT BREAKER COMPRISING PARALLEL CONNECTED SECTIONS

BACKGROUND OF THE INVENTION

This invention relates to electromagnetic circuit breakers of the type disclosed in U.S. Pat. No. 3,290,627, for example.

It is economically desirable to increase the current carrying capacity of circuit breakers by modifying as little as possible, existing circuit breakers. Toward this end, it has been proposed in the past that the amount of current carrying capacity may be approximately doubled by placing two single pole circuit breakers side-by-side (or tripled by using three side-by-side) and connecting the line terminals together and likewise connecting the load terminals together. The resultant "multi-pole" or, preferably, "multi-section" circuit breaker is a single pole circuit breaker in the sense of one current path into and out of the circuit breaker comprised of two or more sections (or "poles").

With such a construction, it is assumed that the current will divide equally through the contacts and through the current sensing devices controlling the tripping of the circuit breaker on overload. It has been found, however, that because the resistance at the contacts varies from section to section of the multi-section circuit breaker, the current will not divide equally among the sections. The result is that nuisance tripping of the circuit breaker has resulted when the unequal division of the current has caused enough current to pass through one of the current sensing devices to cause it to trip its associated mechanism.

It is an object of this invention to combine single pole circuit breakers together to result in multi-section single pole circuit breakers of greatly increased current carrying capacity while also minimizing nuisance tripping.

It is a further object of this invention to provide an economical arrangement for equally dividing the current through the sections of the circuit breaker.

BRIEF SUMMARY OF THE INVENTION

A circuit breaker is provided which comprises two or more sections connected in parallel with each other. Each section of the circuit breaker comprises an electromagnetic sensing device and a set of relatively movable contacts.

The electromagnetic sensing devices are electrically connected at one of their ends to the load terminals. The load terminals are electrically connected in parallel with each other. The electromagnetic sensing devices are electrically connected at their other ends to each other and are electrically connected to all of the movable contacts which are themselves all electrically connected together. The stationary contacts are connected to line terminals which are also electrically connected in parallel with each other.

Thus, the electromagnetic sensing devices are connected in parallel at both of their ends and the relatively movable contacts are also connected in parallel at both of their electrical ends while the electromagnetic sensing devices, on the one hand, and the relatively movable contacts, on the other hand, are also in series with each other, whereby the current is divided equally among all of the electromagnetic sensing devices, even though the current may not be equally divided among all of the relatively movable contacts, because of varying contact resistances.

The foregoing and other objects of the invention, the principles of the invention and the best modes in which I have contemplated applying such principles will more fully appear from the following description and accompanying drawings in illustration thereof.

BRIEF DESCRIPTION OF THE VIEWS

DESCRIPTION OF THE PREFERRED EMBODIMENT

Figure 1:
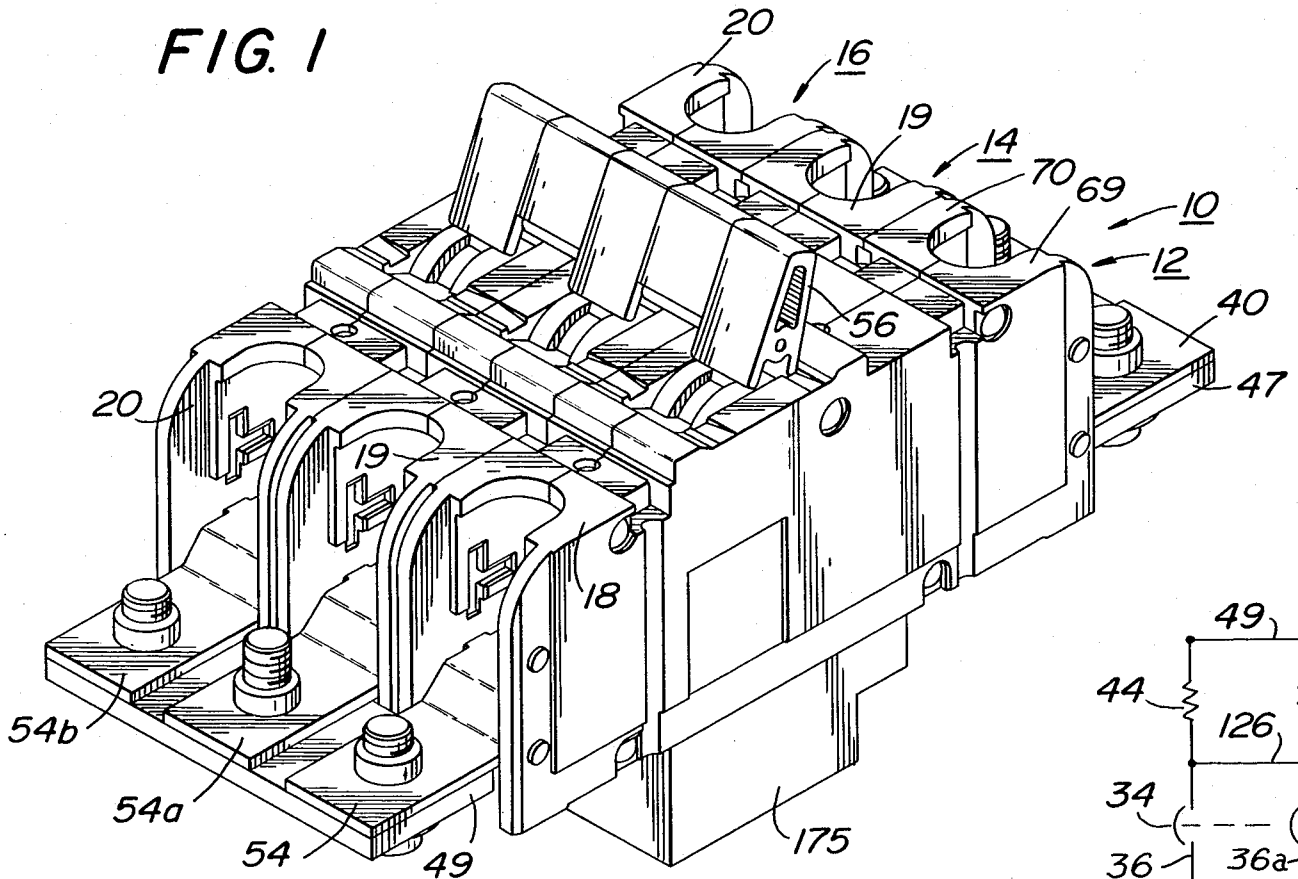
FIG. 1 is a top and front perspective view of a circuit breaker incorporating this invention.

Referring to the drawings, a single pole electromagnetic circuit breaker 10 is shown comprised of three sections 12, 14 and 16, as shown in FIG. 1. Each of the sections 12, 14 and 16 is similarly constructed but for brevity only the parts of the section 12 will be described in detail with only those parts of section 14 and 16 being described as are necessary for an understanding of this invention. Electromagnetic circuit breakers with linkage mechanisms and electromagnetic sensing devices similar to those incorporated in the circuit breaker 10 are described in U.S. Pat. Nos. 3,058,008; 3,290,627; 3,329,913; and 3,955,162, among others.

Figure 3:
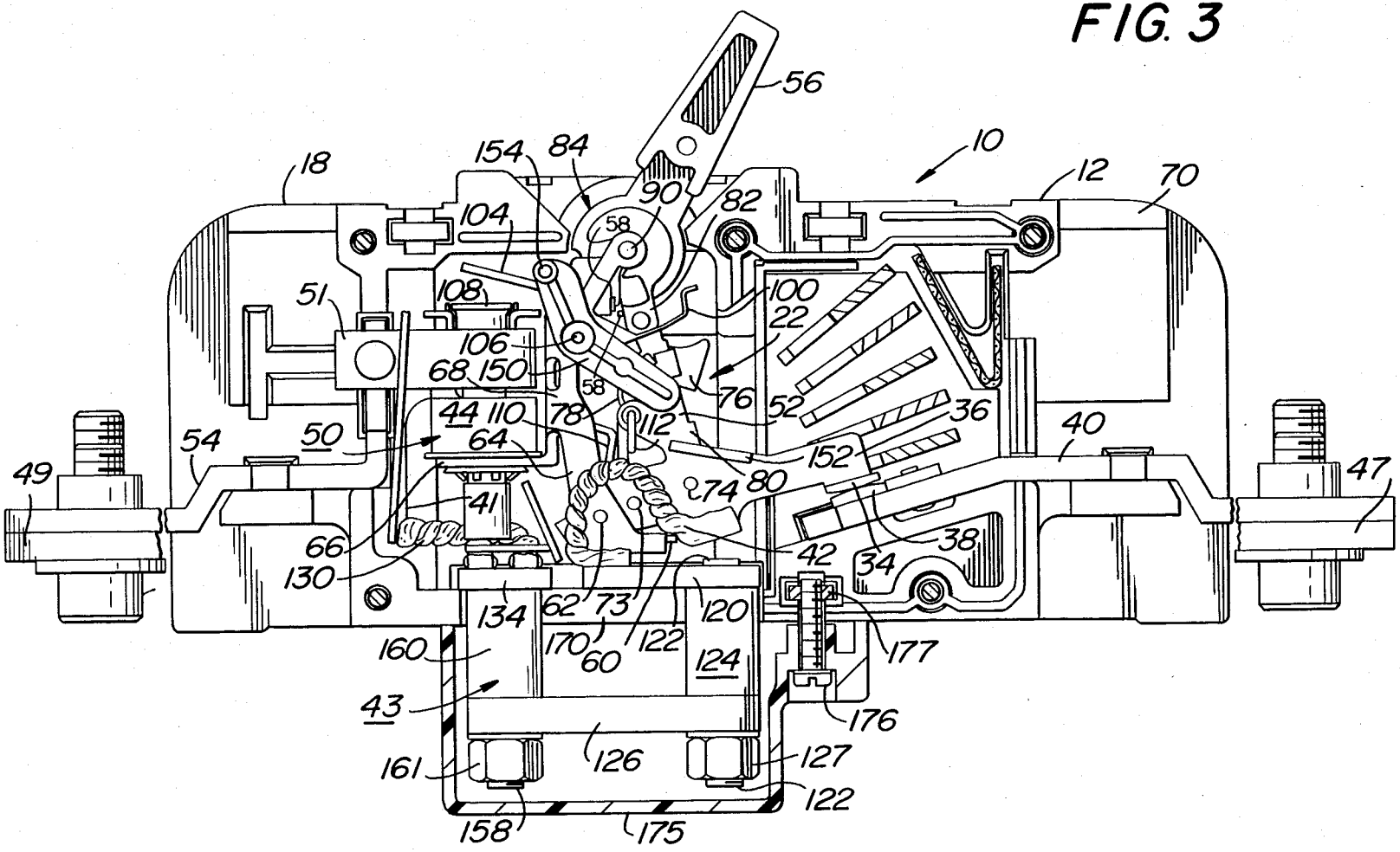
FIG. 3 is a longitudinal, side elevation view of the circuit breaker showing one of the half-cases removed with the contacts shown in the contacts closed position, the view being partially in section.
Figures 4, 5:
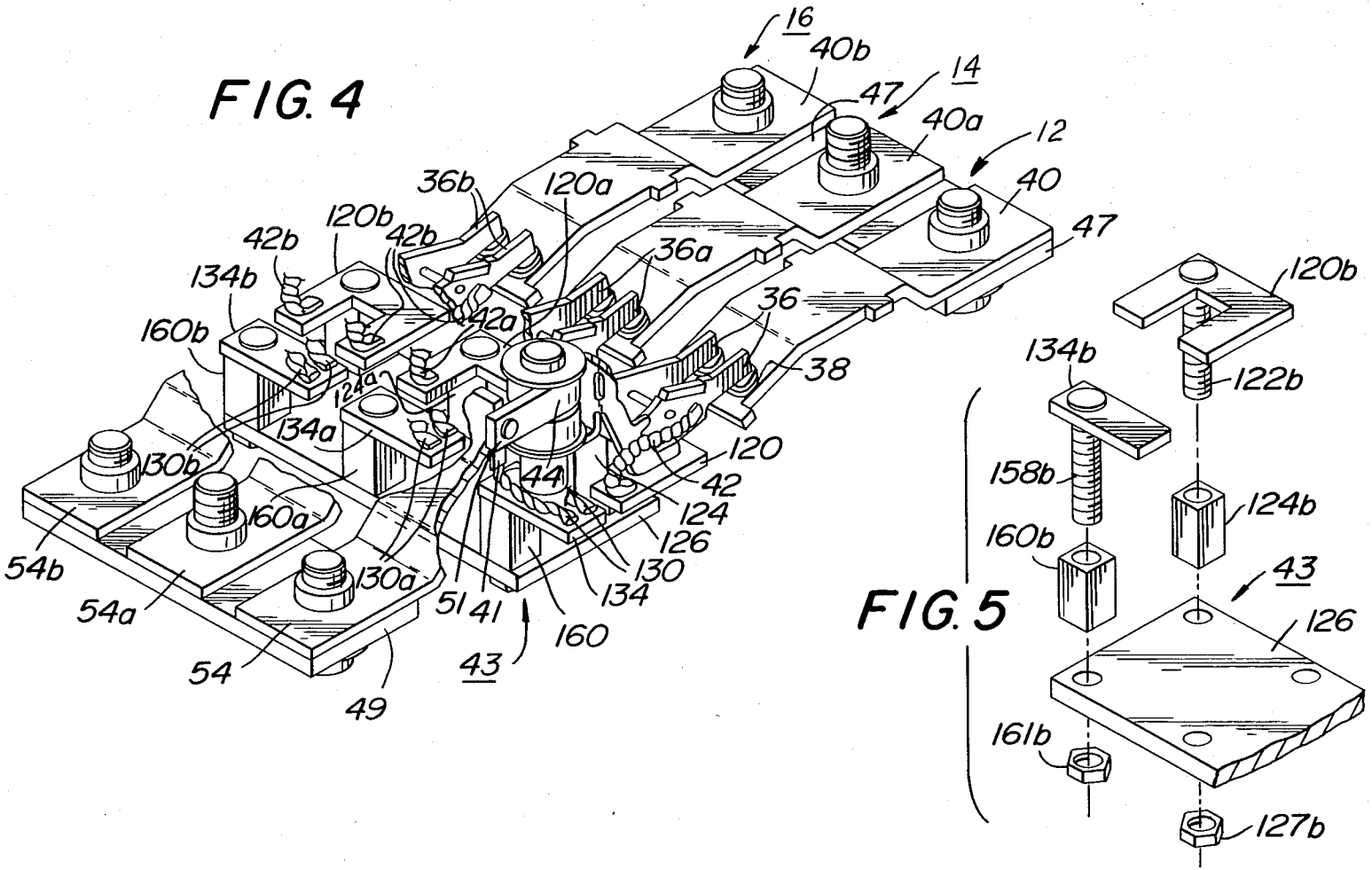
FIG. 4 is a top perspective view of a portion of the circuit breaker shown in FIG. 1 with all of the cases and showing the shunt plate which connects in parallel the electromagnetic sensing devices and the movable contact arms.
FIG. 5 is a partial perspective view showing a part of the shunt plate and one set of posts and brackets.

The sections 12, 14 and 16 include cases 18, 19 and 20, respectively. The section 12 also includes, as seen in FIGS. 3 and 4, an assembly 22 comprising two movable contacts 34 carried by two movable arms 36 and engageable with two stationary contacts 38, the latter being carried by a terminal 40. The two movable arms 36 are connected by two flexible conductors 42 through the shunt device 43 of this invention by a flexible conductor 130 to one end 41 of a coil 44 forming part of an electromagnetic sensing device 50. The electromagnetic sensing device 50, on predetermined electrical conditions, collapses a resettable linkage mechanism 52 to trip open the contacts 34 and 38. The electrical circuit of the section 12 is completed by connecting the other end 51 of the coil 44 to a terminal 54. The collapsible linkage mechanism 52 is of the type that resets, i.e., relatches, automatically after the contacts 34 and 38 are tripped open and the handle 56 is moved toward the "off" position by a handle spring 58.

Further, the movable arms 36 are biased by a spring 60 toward the open position of the contacts 34 and 38 and the movable arms 36 are mounted on a pin 62 about which they pivot, the pin 62 being carried by two spaced frame plates 64 which are part of an L-shaped frame member 66 and jointly form a frame 68 for carrying the coil 44. The end portions of the pin 62 extend into holes (not shown) formed in the opposed side walls of the case 18 formed by half-cases 69 and 70 to properly locate and support the assembly 22 inside the compartment or cavity formed by the half-cases 69 and 70. Another pin 73, carried by the movable arms 36, has end portions which engage the spaced frame plates 64 to limit the opening movement of the arms 36 in the open position of the contacts 34 and 38, the open position of the contacts 34 and 38 not being shown.

The movable arms 36 are also connected by a pin 74 to the linkage mechanism 52 which includes a collapsible toggle assembly 76 having a toggle catch 78 and a U-link 80. The toggle catch 78 is in turn connected to an arm 82 of the pivotal link 84 by a further pin 86. The link 84 is formed with the integral handle 56 and pivots about a pin 90 having its end portions also carried by the spaced frame plates 64. Further, the handle spring 58 is coiled about the pin 90 and has one end attached to one of the frame plates 64 and the other end of the handle spring 58 is in contact with the arm 82, the spring 58 being stressed at all times so as to bias the link 84 in the counterclockwise direction, to the contacts open or "off" position.

After tripping of the linkage mechanism 52 in response to overload, for instance, the handle spring 58 automatically moves the handle link 84 from the contacts closed (circuit breaker "on" position) towards the contacts open (circuit breaker "off" position), but is prevented from doing so by the handle stop 100 resulting in the link 84 being restrained in a central position with the toggle assembly 76 not relatched, as would be the case but for the handle stop 100. When the handle 56 is manually moved past the handle stop 100, the handle spring 58 will move the link 84 to the contacts open or "off" position and automatically relatch the toggle assembly 76.

The frame 68 forms a part of the electromagnetic sensing device 50 to which may be secured a time delay tube 102 housing a spring biased magnetizable core (not shown) movable against the retarding action of a suitable fluid to provide a time delay before tripping of the mechanism on certain overloads, as is well known.

The operation of this type of linkage mechanism 52 and electromagnetic sensing device 50 is set forth in U.S. Pat. No. 3,329,913 and others, but for purposes of completeness it will only be briefly described herein as follows—if the circuit breaker 10 is in the contacts open position (not shown) when the pivotal handle 56 is moved from the contacts open position to the contacts closed position, the toggle assembly 76 and the movable arm 36 all move down, against the bias bf the spring 60, and move the contacts 34 into engagement with the stationary contacts 38 achieving the contacts closed position, the position illustrated in FIG. 3.

The electromagnetic device 50 includes an armature 104 which is pivoted on a pin 106 whose end portions are also carried by suitable holes in the frame plates 64. Upon the occurence of a predetermined overload condition, assuming the circuit breaker to be in the contacts closed position, the armature 104 is attracted toward a pole piece 108, either after a time delay period or without an intentional time delay period, i.e., virtually instantaneously, depending on the overload condition. The movement of the armature 104 toward the pole piece 108 causes the oppositely extending trip finger 110, which is integral with the armature 104, to pivot to the right as seen in FIG. 3 and engage and trip the arm 112 forming part of the linkage mechanism 52, whereupon the toggle assembly 76 collapses and the movable arms 36 move upward under the bias of the spring 60 to open the contacts 34 and 38. The collapsing motion of the toggle assembly 76 is independent of the position of the link 84 and the handle 56. The handle 56 is then moved toward the contacts open position, under the pressure applied by the spring 58.

The sections 12, 14 and 16 are provided with a common tripping arrangement which is well known in the art and similar to the common tripping arrangement shown in U.S. Pat. No. 3,290,627. Referring to FIG. 3 and to the section 12, the common tripping arrangement includes a cam 150 pivotally mounted on the pin 106. One of the movable arms 36 has a projection 152 which upon the opening of the contacts 34 and 38 due to an overload in the coil 44 will engage the lower end of the cam 150 and rotate it counterclockwise. The upper portion of the cam 150 carries a connecting rod 154 adjacent to the portion of the armature 104 which is attractable to the pole piece 108. The connecting rod 154 extends across all three sections 12, 14 and 16 and is received in corresponding cams (not illustrated) in the sections 14 and 16. When one section 12, 14 or 16 is overloaded and the movable arms of that section move to the open contacts position, the cam of that section will be rotated and, because of the connecting rod 154, the cams of the non-overloaded sections will be pivoted into engagement with their armatures to rotate the armatures in the direction to cause the tripping finger of the associated armature to engage the arm of the associated toggle assembly and unlatch the latter, causing the linkage mechanisms of the non-overloaded sections to also collapse, thereby to open all of the contacts of the circuit breaker 10 in a manner well known in the art.

The shunt device 43 of this invention comprises a U-shaped bracket 120 to which the flexible conductors 42 are welded, one conductor being welded to each leg of the "U" of the bracket 120. A suitable threaded stud 122 is clinched to the bracket 120 and extends through a post or spacer 124 and a suitable hole in a shunt plate 126 and the latter is secured thereto by a suitable nut 127. Likewise, the flexible conductor 130 is welded at its midportion to the end portion 41 of the coil 44 and has its two ends welded to a bracket 134. A further threaded stud 158 is clinched to the bracket 134 and extends through a further post 160 and a suitable hole in the shunt plate 126 and the latter is further secured thereto by a nut 161.

Referring to FIGS. 3 and 4, the line and load terminals 40, **40*a* and 40*b* and 54, 54*a* and 54*b*, respectively, all carry suitable captive fasteners providing threaded holes. The line terminals 40, 40*a* and 40*b* are bridged by a conductive bar 47 secured thereto by suitable screws, as shown, to provide a parallel electrical connection. Likewise, the load terminals 54, 54*a* and 54*b* are bridged by a conductive bar 49 secured thereto by suitable screws, as shown, to provide a parallel electrical connection. The screws extending through the terminals 40*a* and 54*a*** are longer than the others to permit the line and load conductors (not shown) to be attached thereto.

The foregoing construction, in one embodiment, makes possible the use of a single pole D.C. circuit breaker rated at 225 amperes and 160 volts D.C. as one section of a multisection circuit breaker to achieve a single pole circuit breaker rated at 400 amperes and 160 volts D.C. by the use of two sections side-by-side, and to achieve a single pole circuit breaker rated at 700 amperes and 160 volts D.C. by the use of three sections side-by-side when they are connected in parallel as disclosed herein and the construction of each section is modified as disclosed herein.

The shunt plate 126 is made large enough and of a highly conductive material, preferably copper, to provide a very low resistance to the flow of current between the flexible conductors 42, 42*a* and 42*b*, on the one hand, and the flexible conductors 130, 130*a* and 130*b* on the other end, FIG. 4. Toward this end, the brackets 120, 120*a* and 120*b*, the posts 124, 124*a* and 124*b*, the shunt plate 126, the posts 160, 160*a* and 160*b*, and the brackets 134, 134*a* and 134*b* are preferably all silver plated. Thus, the voltage drop across the shunt device 43 will be very low and the resultant heat loss will also be low.

The shunt device 43 is secured to the cases 18, 19 and 20 by virtue of the brackets 120, 120*a* and 120*b* and 134, 134*a* and 134*b* which rest upon the lower walls 170 of the half-cases, for example, half-cases 69 and 70 of the case 18, FIG. 3, and which have portions projecting into slots in the side walls of the half-cases 69 and 70.

The shunt device 43 is also provided with a suitable cover 175 which is attached to the cases 18, 19 and 20 by suitable screws 176 threaded into suitable nuts 177 trapped between the half-cases 69 and 70, for example, as shown in FIG. 3.

Figure 2:
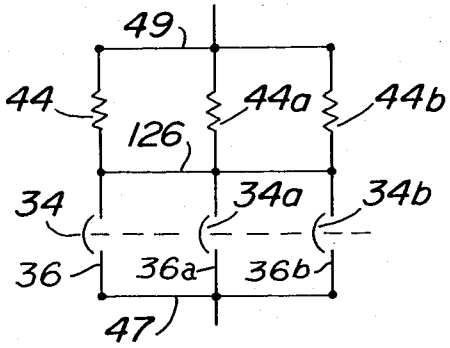
FIG. 2 is a diagrammatic view of the circuit breaker shown in FIG. 1.

Referring to FIG. 2, it is seen that the foregoing construction results in a single pole, i.e., a single current path into and out of the circuit breaker 10, in which the current is equally divided through the three coils 44, 44*a* and 44*b* of the circuit breaker 10 even though, because of varying contact resistances, the current through the three sets of relatively movable contacts 34 and 38, 34*a* and 38*a*, and 34*b* and 38*b* may not be equally divided. The three coils 44, 44*a* and 44*b* are connected in parallel with each other at both of their coil ends by the bar 49 on one side and the shunt plate 126 on the other side. Likewise, the three sets of movable contacts 34 and 38, 34*a* and 38*a*, and 34*b* and 38*b* are connected in parallel with each other at both of their ends by the shunt plate 126 on the one side and the bar 47 on the other side. However, the arrangement described and illustrated places the group of coils 44, 44*a* and 44*b* in electrical series with the group of relatively movable contacts 34 and 38, 34*a* and 38*a* and 34*b* and 38*b*.

It will be understood that in its simplest form this invention could be practiced by directly connecting together the flexible conductors 130, 130*a* and 130*b* with the flexible conductors 42, 42*a* and 42*b*, but this construction is not illustrated, so as to form a parallel connection across the coils and the movable contacts, as diagrammatically shown in FIG. 2.

Figure 6:
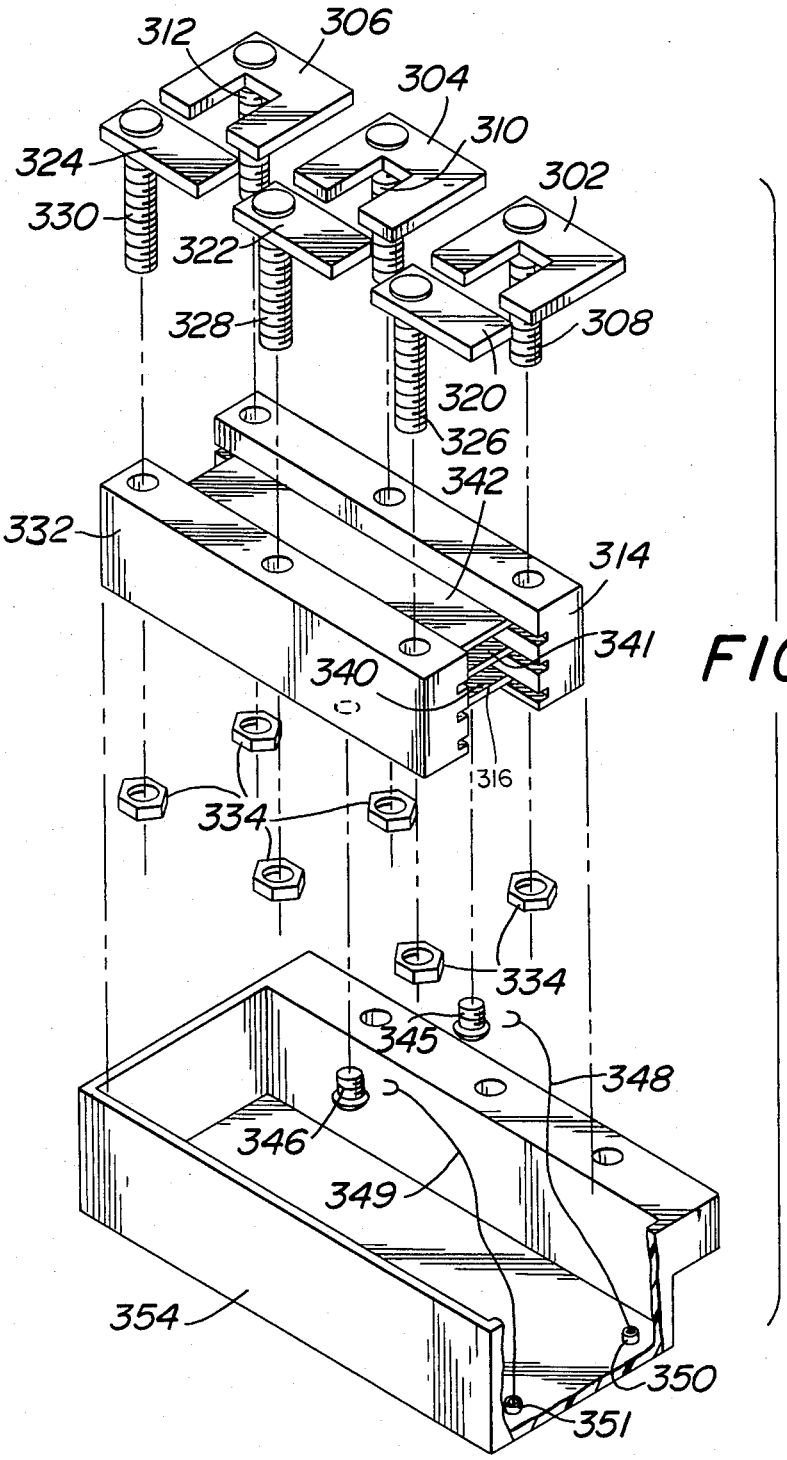
FIG. 6 is a perspective view showing a calibrated shunt plate device, one set of posts and brackets, and a cover for the shunt plate device.

Referring to FIG. 6, a modification of this invention is illustrated in which the shunt device 300 is calibrated in advance so that by connecting a suitable volt meter across the shunt device 300, the current flowing to the circuit breaker may be determined.

The shunt device 300 is intended for a circuit breaker having three sections similar to that described in connection with FIGS. 1 to 5 and includes U-shaped brackets 302, 304 and 306 carrying threaded studs 308, 310 and 312, respectively, which are captive thereto and secured thereto. The studs 308, 310 and 312 extend through suitable holes in a rail 314 of a composite shunt plate 316. Likewise, brackets 320, 322 and 324 carry the threaded studs 326, 328 and 330, respectively, which are captive thereto and secured thereto. The studs 326, 328 and 330 extend through suitable holes in the rail 332. The rails 314 and 332 are secured to the brackets 302, 304, 306, 320, 322 and 324 by suitable threaded nuts 334.

The shunt device 300 described and illustrated in FIG. 6 may be substituted for the shunt device 43 described in connection with FIGS. 1 to 5 and thus will be similarly carried by the cases of the circuit breaker in which it is incorporated.

The rails 314 and 332 have three slots, as shown, which receive three shunt plates 340, 341 and 342, as shown in FIG. 6, the plates 340, 341 and 342 being secured in the slots of the rails 314 and 332 by suitable solder or the like. The size of the plates 340, 341 and 342 is adjusted so that for a predetermined current flow through the shunt device 300 there will be a predetermined voltage drop across two points of the shunt device 300. These two points may be defined by the two screws 345 and 346 which are threaded into suitable holes in the two rails 314 and 332 or some other suitable points. Terminals of suitable lead wires 348 and 349 are connected in contact with the rails 314 and 332 under the heads of the screws 345 and 346 and the other ends of the wires 348 and 349 are connected to female terminals 350 and 351 carried by the cover 354. Thus, when the cover 354 is secured to the circuit breaker (as shown for the previous embodiment) the male terminals of the leads for the meter (not shown) may be inserted into the female terminals 350 and 351.

In one embodiment the rails 314 and 332 are made of copper and the plates 340, 341 and 342 of a manganese-copper alloy whose resistance will not vary significantly as its temperature rises, such alloys being well known in the art, i.e., the resistance of such materials remains substantially constant over a wide variation in temperature. In one circuit breaker having three sections the circuit breaker is rated at 700 amps. and the voltage drop across the calibration points is 25 millivolts. A volt meter across the calibration points thus will read 25 millivolts when the current through the circuit breaker is 700 amps. and the volt meter will read proportionately higher or lower for a higher or lower current through the circuit breaker.

While this invention has been described and illustrated in a circuit breaker 10 in which each of the sections thereof, that is, sections 12, 14 and 16 in FIGS. 3 and 4, have double movable arms, i.e., the two arms 36 shown in FIG. 4 for the section 12, it will be understood that this invention is not limited to such a construction nor to the other details of the described circuit breaker.

It should also be noted that the sensing of the voltage across the calibrated shunt device 300 can be used to switch another circuit "on" or "off" depending on the variation of the voltage at the calibrated shunt device 300 and a suitable switching circuit (not illustrated) could be connected to the terminals 350 and 351 or directly to the shunt device 300 at the calibration points.

Having described this invention, I claim:

1. A single pole circuit breaker comprising at least two sections each section comprising an electromagnetic sensing means, a set of relatively movable contacts, and a mechanism for opening and closing-said contacts in response to said electromagnetic sensing means, all of said electromagnetic sensing means being connected in electrical parallel with each other at both of their electrical ends, all of said sets of relatively movable contacts being connected in electrical parallel with each other at both of their electrical ends, and all of said parallel connected electromagnetic sensing means being electrically connected in series with all of said sets of relatively movable contacts, whereby the current through the two or more electromagnetic sensing means will be divided equally even though the current through the two or more sets of movable contacts may not be equally divided due to varying contact resistance.

2. The combination of claim 1 wherein each section further includes a case, line and load terminals carried by said case, each set of relatively movable contacts comprises stationary and movable contacts within said case, said stationary contact being carried by said line terminal, a movable contact arm, said mechanism includes linkage means for moving said movable arm between open and closed positions, and said electromagnetic sensing means tripping open said contacts on predetermined electrical conditions, and each electromagnetic sensing means being electrically connected at one end to said load terminal.

3. The combination of claims 1 or 2 and further including a shunt means for connecting all of said movable contacts in parallel with each other, all of said electromagnetic sensing means in parallel with each other, and all of said movable contacts in series with all of said electromagnetic sensing means.

4. The combination of claim 3 wherein each of said electromagnetic sensing means including a coil, said shunt means comprises a shunt plate, first bracket means associated with each section for electrically connecting the movable arm to said shunt plate, and second bracket means associated with each section for electrically connecting one end of the coils to said shunt plate.

5. The combination of claim 4 wherein said first bracket means secures said shunt plate to said case.

6. The combination of claim 5 wherein said second bracket means also secures said shunt plate to said cases.

7. The combination of claim 6 wherein each of said first and second bracket means includes a body, a threaded stud and a post through which said stud extends, first flexible conductors connecting the movable arms and the bodies of said first bracket means, second flexible conductors connecting the coils and the bodies of said second bracket means, and said studs extending with said shunt plate and being suitably secured thereto.

8. The combination of claim 3 wherein said shunt means is calibrated to provide a predetermined low voltage drop across said shunt means at a predetermined current through said circuit breaker.

9. The combination of claim 8 wherein said shunt means include a shunt plate made from a material whose resistance does not vary substantially as its temperature varies.

10. The combination of claim 9 wherein said shunt plate is made from a manganese-copper alloy.

11. The combination of claim 8 and a switching circuit connected to the calibrated shunt means.

* * * * *